United States Patent [19]

Jones

[11] Patent Number: 4,554,986

[45] Date of Patent: Nov. 26, 1985

[54] ROTARY DRILL BIT HAVING DRAG CUTTING ELEMENTS

[75] Inventor: Kenneth W. Jones, Kingwood, Tex.

[73] Assignee: Reed Rock Bit Company, Houston, Tex.

[21] Appl. No.: 510,693

[22] Filed: Jul. 5, 1983

[51] Int. Cl.[4] ..... E21B 10/54

[52] U.S. Cl. ..... 175/397; 175/329; 175/410

[58] Field of Search ..... 175/329, 330, 339, 340, 175/374, 375, 393, 397, 410, 379

[56] References Cited

U.S. PATENT DOCUMENTS

| | | | |
|---|---|---|---|
| 2,819,043 | 1/1958 | Henderson | 255/61 |
| 2,966,949 | 1/1961 | Wepsala, Jr. | 175/329 |
| 2,990,897 | 7/1961 | Short | 175/330 |
| 2,998,088 | 8/1961 | Bennington, II | 175/329 |
| 3,112,803 | 12/1963 | Rowley | 175/329 |
| 3,135,341 | 6/1964 | Ritter | 175/329 |
| 3,175,629 | 3/1965 | Rowley | 175/329 |
| 3,709,308 | 1/1973 | Rowley et al. | 175/329 |
| 3,743,036 | 7/1973 | Feenstra | 175/330 |
| 3,938,599 | 2/1976 | Horn | 175/329 |
| 4,148,368 | 4/1979 | Evans | 175/329 |
| 4,176,723 | 12/1979 | Arceneaux | 175/329 |
| 4,207,954 | 6/1980 | Jerome | 175/330 |
| 4,244,432 | 1/1981 | Rowley et al. | 175/329 |
| 4,253,533 | 3/1981 | Baker | 175/329 |
| 4,303,136 | 12/1981 | Ball | 175/329 |

FOREIGN PATENT DOCUMENTS

| | | | |
|---|---|---|---|
| 1054039 | 4/1959 | Fed. Rep. of Germany | 175/329 |

*Primary Examiner*—James A. Leppink
*Assistant Examiner*—Hoang C. Dang
*Attorney, Agent, or Firm*—Carl A. Rowold

[57] ABSTRACT

A rotary drill bit comprising a bit body having a plurality of drag cutting elements mounted on the bottom thereof. Each cutting element has a portion projecting down below the bit body and forward generally in the direction of rotation of the bit. This portion presents a leading face and a trailing face which converge at an acute angle to form a cutting edge. Each element is positioned on the bit body such that its leading and trailing faces present a positive rake angle and back clearance, respectively, to the surface of the well bore formation for improved cutting action. The bit body has an exit port at the bottom thereof for flow of drilling fluid under pressure, and sets of first and second generally parallel ridges defining watercourses extending from the exit port to the periphery of the bit. The cutting elements are mounted on the second or trailing ridge, and extend toward but stop short of the first or leading ridge. The leading face and cutting edge of each element thus extend into the watercourse and are cooled and cleaned by the drilling fluid. In addition the leading ridge extends down to a level below the bottom of the trailing ridge but above the cutting edges for limiting the depth of penetration of the cutting element.

3 Claims, 5 Drawing Figures

ROTARY DRILL BIT HAVING DRAG CUTTING ELEMENTS

BACKGROUND OF THE INVENTION

This invention relates to rotary drill bits for drilling bores in the earth such as for oil and gas wells, and more particularly to rotary drill bits of the so-called "drag" type.

This invention involves an improvement over rotary drill bits of the aforementioned "drag" type. Drag bits now in use in the oil well drilling industry typically have a bit body and a plurality of cutting elements mounted on the bottom of the bit body which "cut" the formation at the bottom of the well bore as the bit is rotated. The cutting elements are of two principal types; namely, (1) natural diamond elements, and (2) polycrystalline or synthetic diamond elements. Rotary drag bits are characterized as either "natural diamond" bits or "polycrystalline diamond" bits, depending on which of the two types of elements is used for the primary cutting elements of the bit.

Natural diamond bits, such as those shown for example in U.S. Pat. Nos. 3,112,803, 3,135,341, and 3,175,629, have been used in various designs in the oil well drilling industry for a relatively long time. Typically, in these bits, the natural diamond cutting elements have a base portion affixedly secured to the bottom of the bit body, and a projecting portion extending below the bottom of the bit body and engageable with the formation at the well bore bottom for cutting it. Although these cutting elements are naturally occurring and thus are of somewhat irregular shape, the projecting portions of the cutting elements are typically of generally conical or spherical shape. The cutting elements are mounted on the bit bottom with the longitudinal axes of the projecting portions generally perpendicular to the bottom face of the bit. Because of the shape and position of the projecting portions of the cutting elements, the leading or cutting faces thereof present a negative rake angle to the surface of the formation to be cut, with the tips of the cutting elements thus applying a relatively high compressive load on the formation. In most instances, the cutting elements cut the formation by so-called compressive action, in which the formation chips or spalls under the compressive load. However, the cutting elements may also cut by means of abrasive action or plowing action.

Regardless of the type of cutting action utilized, the rate of penetration of natural diamond bits is limited by, among other factors, the necessity of providing adequate cooling of the natural diamond cutting elements. More particularly, cooling of the cutting elements is required to prevent overheating of the elements. Such heating leads to phase transformation of the "hard" diamond to "soft" graphite, with resultant destruction of the cutting elements. Adequate cooling of the cutting elements can be provided only if the weight applied to the bit is sufficiently low as to allow only partial penetration of the cutting elements into the formation (i.e., less than the full height of the projecting portions of the cutting elements). This partial penetration provides a space for flow of drilling fluid between the bottom of the bit and the well bore bottom. The drilling fluid flowing in the space cools and cleans the cutting elements as it flows past them. Because of the high cost of the diamond cutting elements and the bit's relatively low rates of penetration, natural diamond bits typically are used only in conditions which cannot be drilled satisfactorily by tri-cone bits, such as deep hole drilling in shales and salts, which are ductile under overbalance conditions.

Synthetic diamond drill bits, such as those shown for example in U.S. Pat. Nos. 4,244,432, 4,253,533 and 4,303,136, have a plurality of cutting elements, each comprising a stud of hard metal, such as tungsten carbide, projecting from the bottom of the bit and a disc of hard metal having a thin layer of polycrystalline diamond material thereon bonded to the stud. Each cutting element presents a cutting face having a negative rake angle and a cutting edge which engages and cuts the formation at the bottom of the well bore. The projecting portions of the cutting elements are relatively long and provide a space for flow of drilling fluid between the bottom of the bit and the well bore bottom. This space is of relatively large cross-sectional area and thus the flow rate of drilling fluid is relatively low. In drilling certain formations, such as ductile or sticky formations, the flow rate of the drilling fluid past the cutting elements is not sufficient to provide adequate cooling and cleaning of the cutting elements for high rates of drilling penetration. For example, in drilling sticky formations, so-called "bit-balling" may occur, in which the bit bottom is covered with a thick layer of the formation, which engages the well bore bottom and slows the rate of penetration. Attempts to increase the flow rate by shortening the height of the projecting portions of the cutting elements or otherwise reducing the cross-sectional area of the space between the bottom of the bit and the formation have been limited by the fact that the bond between the polycrystalline diamond layered disc and the stud, which is typically a brazed connection, is susceptible to erosion by the flowing drilling fluid. Thus, like the natural diamond bit, the synthetic diamond bit has been used for drilling well bores only in relatively limited applications.

SUMMARY OF THE INVENTION

Among the objects of this invention may be noted the provision of an improved "drag" type rotary drill bit capable of drilling in a relatively wide range of formations at relatively high rates of penetration; the provision of such a drill bit which has cutting elements having leading faces presenting a positive rake angle to the surface of the formation to be cut for cutting the formation by means of shearing action; the provision of such a drill bit in which the cutting elements have trailing faces providing back clearance relative to the surface of the formation to be cut for extended cutting element life; the provision of such a drill bit which provides protection against damage to the cutting elements due to excess "weight on bit"; the provision of such a drill bit having cutting elements which penetrate the well bore bottom formation relatively deeply as compared to the cutting elements of natural diamond bits; and the provision of such a drill bit which has an improved drilling fluid circulation system for enhanced cooling and cleaning of the cutting elements and removal of chips cut from the formation.

More particularly, the drill bit of this invention comprises a bit body having a threaded pin at its upper end adapted to be detachably secured to drill pipe or the like for rotating the bit, and a plurality of drag cutting elements mounted on the bottom of the bit body. Each cutting element has a portion projecting down below the bottom of the bit body and forward in the direction of rotation of the bit. The projecting portion presents a leading face and a trailing face with respect to the direction of rotation of the bit, with these faces converging to form a cutting edge engageable with the formation at the bottom of the well bore. The angle of convergence of the faces is an acute angle. Each cutting element is positioned on the bit body such that the leading and trailing faces of the cutting element present a positive rake angle and back clearance, respectively, to the surface of the well bore formation to be cut by the cutting element for improved cutting action by the cutting element, faster rates of penetration by the drill bit, and extended cutting element life.

The drill bit further has passaging in the bit body extending from the pin to an exit port in the bottom of the bit for flow of drilling fluid under pressure from the drill pipe through the bit body; and first and second ridges on the bottom of the bit body extending from adjacent the center to adjacent the periphery of the bottom of the bit body in generally parallel spaced relation to each other, thereby forming a watercourse therebetween in flow communication with the exit port. The cutting elements are mounted in side-by-side relation on the second or trailing ridge, with each element being spaced from the elements adjacent thereto to form gaps therebetween. Each element further projects below the bottom of the trailing ridge to a cutting edge engageable with the formation at the bottom of the well bore. The bottom of the first or leading ridge is spaced below the bottom of the trailing ridge but above the bottom of the cutting edges of the cutting elements, whereby the leading ridge is adapted to engage the formation at the bottom of the well bore to limit the depth of penetration of the cutting elements into the formation and to block fluid flow between the leading ridge and the formation. Thus, the drilling fluid exits the watercourse via the stated gaps for enhanced cleaning and cooling of the cutting elements by the drilling fluid.

In addition, the cutting elements project from the trailing ridge toward but stop short of the leading ridge, with the leading face and cutting edge of each cutting element thus being positioned in the watercourse. Accordingly, the drilling fluid flowing in said watercourse flows over and impinges the leading faces and cutting edges of the cutting elements for improved cleaning and cooling thereof.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
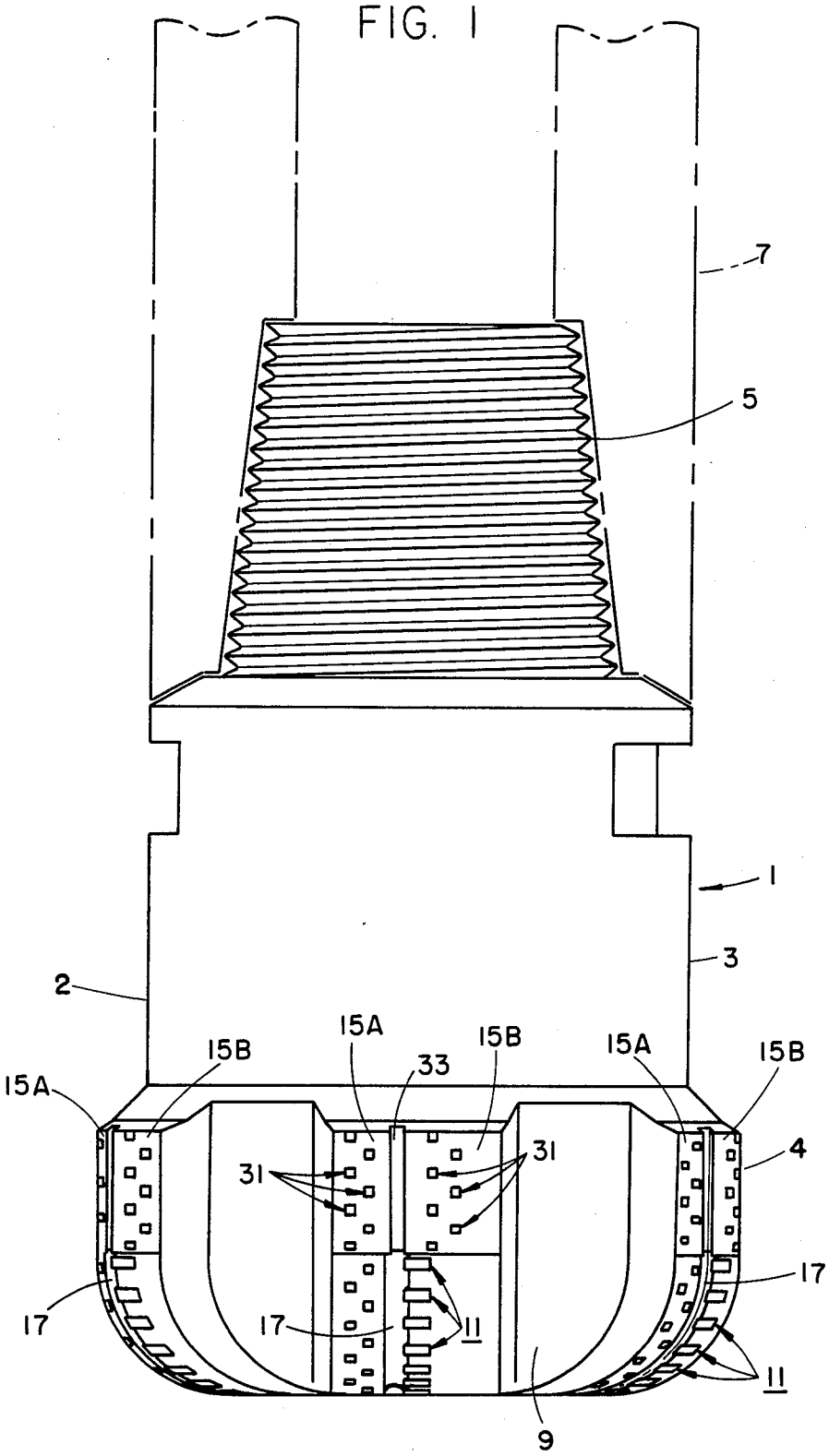
FIG. 1 is an elevation of a drill bit of this invention.
Figure 2:
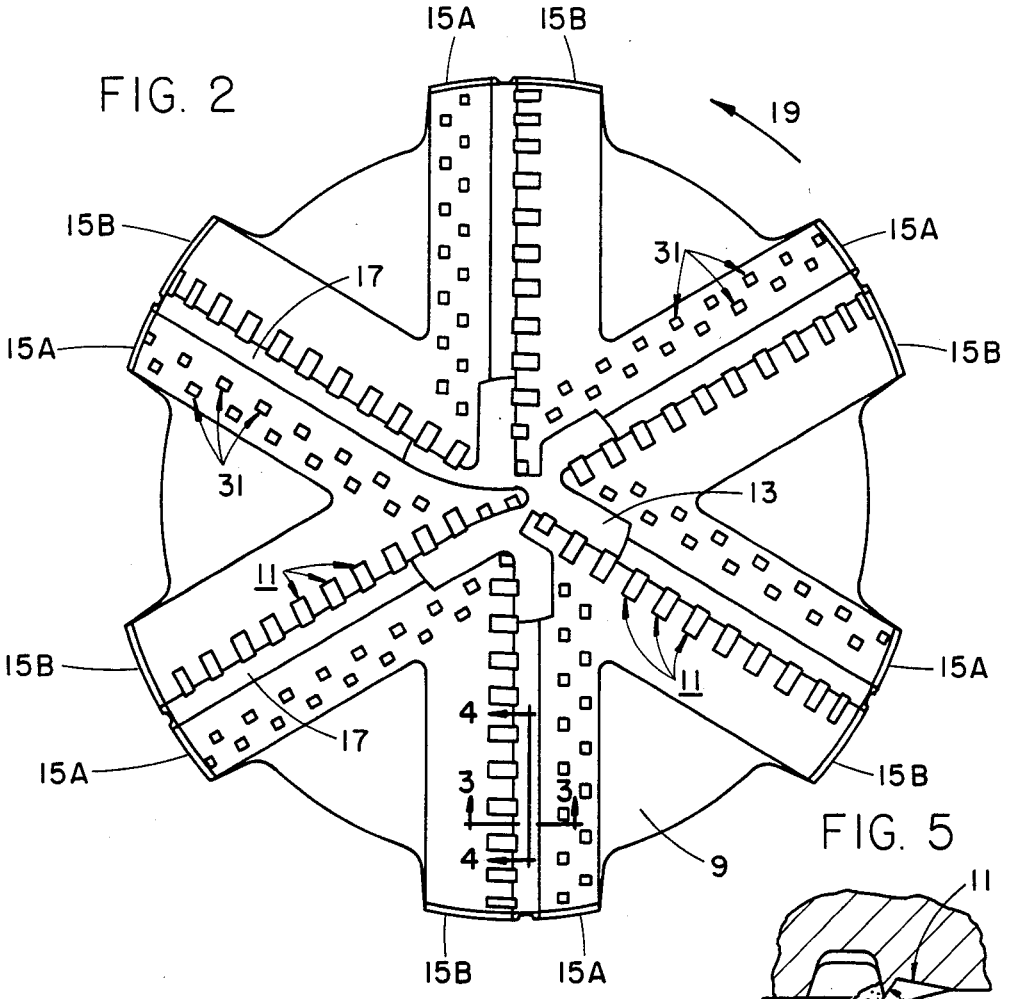
FIG. 2 is a bottom plan of the bit of FIG. 1 showing sets of generally parallel ridges on the bit bottom and a plurality of cutting elements on the trailing ridge of each set of ridges.

Referring to FIG. 1, there is generally indicated at 1 a rotary drill bit of this invention for drilling bores in the earth for oil and gas wells. The bit 1 comprises a bit body 2 having an upper portion 3 and a lower portion 4 secured to the upper portion by conventional fastening means (not shown). The upper portion 3 is preferably formed of steel and has a threaded pin 5 at its upper end adapted to be detachably secured to drill pipe or the like (shown in phantom at 7) for rotating the bit. The lower portion 4 of the bit body is preferably formed of a so-called tungsten carbide matrix material by a conventional infiltration process. This matrix material has good wear and erosion resistance properties. However, it is contemplated that the lower portion 4 may also be made of steel, with a coating of suitable wear-resistant material (not shown) applied to the bottom 9 of the bit. As best illustrated in FIG. 2, the bit further comprises a plurality of drag cutting elements 11 mounted on the bottom of the bit body, as by being integrally formed into the lower portion of the bit body. The cutting elements 11 are preferably of synthetic diamond material, and have a triangular shape in section. Such cutting elements are commercially available under the tradename "GEOSET" from the General Electric Corporation of Worthington, Ohio.

The bit body 2 has passaging (not shown) therein extending from the threaded pin 5 to an exit ports 13 which may have a plurality of branches as illustrated in the bit bottom 9 for flow of drilling fluid under pressure from the drill pipe through the bit body. At its bottom, the bit body has a plurality of sets of two generally parallel ridges 15A, 15B (e.g., six such sets of ridges, as illustrated in FIG. 2). Each set of ridges extends from adjacent the center of the bit bottom 9 to the periphery of the bit bottom (see FIG. 2) and then upwardly along the side of the bit body (see FIG. 1), with each set forming a watercourse 17 in communication with a respective exit branch port 13 for flow of drilling fluid. A first ridge 15A of each set of ridges constitutes a leading ridge with respect to the direction of rotation of the bit, which is represented by the arrow 19 in FIG. 2. The second ridge 15B of each set of ridges thus constitutes a trailing ridge.

Figure 5:
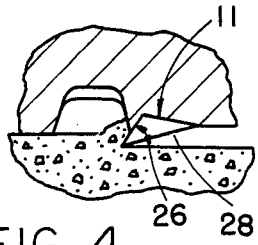
FIG. 5 is a cutaway view of FIG. 3 showing the positive rake angle and back clearance of the cutting element.
Figure 3:
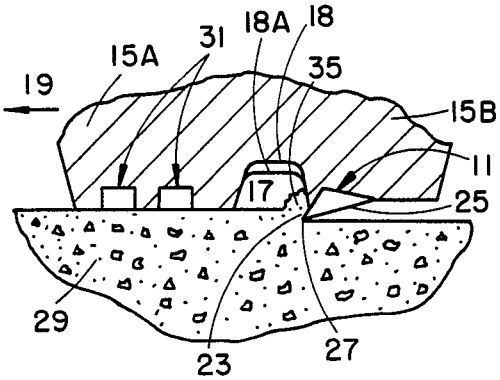
FIG. 3 is an enlarged vertical section on line 3—3 of FIG. 2, with the bit in engagement with the formation at the bottom of a well bore, showing the relative positions of the bottoms of the ridges of one of the sets of ridges and the cutting edge of one of the cutting elements.
Figure 4:
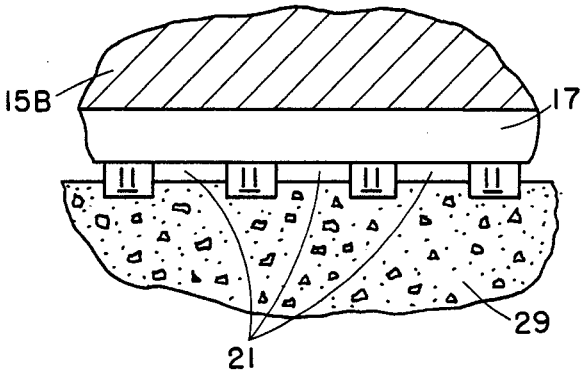
FIG. 4 is an enlarged vertical section on line 4—4 of FIG. 2 showing gaps between adjacent cutting elements for flow of drilling fluid.

The drag cutting elements 11 are embedded in the trailing ridge 15B of each of the sets of ridges in side-by-side spaced apart relation, thereby forming gaps 21 between adjacent cutting elements. Each cutting element 11 projects down below the bottom of the trailing ridge and forward in the direction of rotation of the bit, with the element extending toward but stopping short of the leading ridge 15A. As positioned on the trailing ridge as shown in FIG. 3, each cutting element has a leading face 23 and a trailing face 25 with respect to the direction of rotation of the bit. The faces converging at an acute angle, less than approximately 85°, to form a cutting edge 27 engageable with the formation 29 at the bottom of the well bore. As further illustrated in FIGS. 3 and 5, each cutting element is positioned on the bit body such that the leading and trailing faces of the cutting element present a positive rake angle 26 and back clearance 28, respectively, to the surface of the well bore formation to be cut by the cutting element.

The back clearance of the trailing face 25 reduces drag on the cutting element and thus frictional heating of the cutting element for prolonged life. In addition, the reduction of drag on the cutting elements, enables a reduction in the torque needed to turn the bit, with a resultant increase in cutting efficiency of the bit. The positive rake angle of the leading face 23 enables cutting of the formation by shearing action, which is more effective than the compressive loading action provided by a negative rake angle in cutting formations, such as salts and shales, that are relatively plastically deformable under overbalanced conditions. Being formed of rigid material and immovably mounted on the trailing ridge, the cutting elements (including the cutting edge thereof) are maintained in relatively fixed position between and below the ridges during the use of the drill bit.

Again referring to FIG. 3, the bottom of the leading ridge 15A of a set of ridges is shown to be positioned below the bottom of the trailing ridge 15B of the set, but above the cutting edges 27 of the cutting elements 11 mounted on the trailing ridge. Upon the application of a weight on the bit 1 less than a predetermined weight, the cutting elements 11 will penetrate the formation to a depth dependent on the amount of the weight. However, upon application of a weight on the bit in excess of the predetermined weight, the leading ridge, because of its position relative to the trailing ridge and the cutting elements, engages the formation 29 at the well bore bottom for limiting the depth of penetration of the cutting elements 11 into the formation. Thus the leading ridge enables the cutting elements to penetrate to a depth deep enough to enable rapid removal of the formation, yet not so deep as to prevent the cutting elements from being adequately cooled and cleaned by the drilling fluid. Thus, the bit 1 provides protection against damage to the cutting element due to excess weight on the bit. For increased wear resistance, the leading ridge, as well as the trailing ridge at its upper end (see FIG. 1), has a plurality of relatively hard wear elements 31, such as of diamond or tungsten carbide, embedded therein.

In addition, because of the position of the bottom of the leading ridge 15A relative to the trailing ridge 15B and the cutting elements 11, the leading ridge, when in engagement with the well bore bottom formation, blocks drilling fluid flow between the leading ridge and the formation and thus causes the fluid to exit the respective watercourse 17 via the gaps 21 between adjacent cutting elements, and via the outer or upper end 33 of the watercourse 17 at the side of the bit body 2 (see FIG. 1). To provide more or less uniform flow through all of the gaps 21, the watercourse is so configured that its cross-sectional area decreases from adjacent the center of the bit to the periphery of the bit. Preferably, this change in cross-sectional area is effected by changing the depth of the watercourse 17 along its length, as illustrated in FIG. 3 showing the top of the watercourse at two locations along its length, designated 18, 18A. In addition, to ensure that a substantial portion of the drilling fluid flowing in the watercourse 17 flows through the gaps and not out the outer end 33 of the watercourse, the cross-sectional area of the watercourse along the side of the bit body is made relatively small compared to its cross-sectional area at the bottom of the bit body, see FIG. 1.

As stated previously, each cutting element projects from the trailing ridge 15B toward but stops short of the leading ridge 15A. Thus, the leading face 23 and the cutting edge 27 of the cutting elements may be considered to be positioned within the drilling fluid passage defined by the opposed side walls of the ridges 15A, 15B, the surface of the bit body at the top 18 of the watercourse 17, and the formation 29. This arrangement, together with the relative positions of the ridges 15A, 15B and the cutting elements 11 causes the drilling fluid to flow in the watercourse 17 at a relatively high velocity over and in impringement with the cutting elements for improved cleaning and cooling of the cutting elements, and enhanced formation chip removal (one such chip being designated 35 in FIG. 3). Thus, compared to a typical synthetic diamond drill bit, in which the drilling fluid flows past the cutting elements at an average fluid velocity of less than 5 feet per second, the drill bit 1 has far higher fluid velocities. However, because of the high erosion resistant properties of the tungsten carbide lower portion 4 and the diamond cutting elements 11, and the embedding of the elements in the bit body so as to leave no exposed bonding areas, the bit body and cutting elements are not significantly eroded by the high velocity drilling fluid.

It will be observed from the foregoing that the drill bit of this invention enables cutting of the formation by shearing action, which is a more effective cutting action than compressive loading for many commonly encountered formations. In addition, by confining the drilling fluid to flow in relatively small cross-section watercourses and positioning the cutting elements within the watercourses, the drilling fluid flows at a relatively high velocity over the cutting elements, for improved cooling and cleaning of the elements and enhanced chip removal. Thus, in contrast to conventional natural or synthetic diamond drag bits, the drill bit of this invention is capable of drilling a relatively wide range of formations at relatively high rates of penetration.

As various changes could be made in the above constructions without departing from the scope of the invention, it is intended that all matter contained in the above description or shown in the accompanying drawings shall be interpreted as illustrative and not in limiting sense.

What is claimed is:

1. A rotary drill bit for drilling a well bore comprising:

a bit body having a threaded pin at its upper end adapted to be detachably secured to drill pipe or the like for rotating the bit and for delivering drilling fluid under pressure to the bit body, an exit port in the bottom of the bit body for exit of drilling fluid under pressure from the bit body, and first and second ridges on the bottom of the bit body extending from adjacent the center to adjacent the periphery of the bottom of the bit body in spaced relation to each other thereby forming a watercourse therebetween in flow communication with said exit port;

a plurality of drag cutting elements mounted in side-by-side relation on the second ridge, each element being spaced from the elements adjacent thereto and projecting below the bottom of the second ridge to cutting edges engageable with the formation at the bottom of the well bore to form gaps between the cutting elements in fluid communication with the watercourse for flow of drilling fluid therethrough, each element further being of relatively rigid material and immovably mounted on the second ridge so as to maintain its cutting edge at a relatively fixed position beneath the bottom of the second ridge, the bottom of the first ridge being spaced below the bottom of the second ridge but above the bottom of the cutting edges of the cutting elements, whereby the first ridge is adapted to engage the formation at the bottom of the well bore to limit the depth of penetration of the cutting elements into the formation and to block fluid flow between the first ridge and the formation, thereby causing the drilling fluid to exit said watercourse via said gaps for enhanced cleaning and cooling of the cutting elements by the drilling fluid.

2. A rotary drill bit as set forth in claim 1 comprising a plurality of sets of said first and second ridges on the bottom of the bit body, each of said sets forming a watercourse for flow of drilling fluid.

3. A rotary drill bit as set forth in claim 2 wherein the first ridge of each of said sets of ridges constitutes a leading ridge with respect to the direction of rotation of the drill bit, and the second ridge constitutes a trailing ridge.

* * * * *